US012649606B1

(12) United States Patent
Morris

(10) Patent No.: US 12,649,606 B1
(45) Date of Patent: Jun. 9, 2026

(54) GRINDING TRAY FOR PLANT BASED SMOKING MATERIAL

(71) Applicant: Barry Keith Morris, Richmond, VA (US)

(72) Inventor: Barry Keith Morris, Richmond, VA (US)

( * ) Notice: Subject to any disclaimer, the term of this patent is extended or adjusted under 35 U.S.C. 154(b) by 719 days.

(21) Appl. No.: 18/095,905

(22) Filed: Jan. 11, 2023

(51) Int. Cl.
*B65D 1/34* (2006.01)

(52) U.S. Cl.
CPC ..... *B65D 1/34* (2013.01)

(58) Field of Classification Search
CPC ..... B65D 85/70; B65D 43/166; B65D 1/34; A24F 9/16; A24F 9/04; A24F 15/18; A24F 15/08; A61J 1/00
See application file for complete search history.

(56) References Cited

U.S. PATENT DOCUMENTS 9,402,420 B2 * 8/2016 Barrett ..... A24F 17/00
10,015,985 B1 * 7/2018 Blakely, III ..... A24F 5/00
10,694,894 B1 * 6/2020 Ashton ..... A47J 42/36
11,014,733 B1 5/2021 Gause
11,571,021 B2 * 2/2023 Smith ..... A24F 23/00
2017/0332697 A1 * 11/2017 Roberto, Jr. ..... A24B 7/06
2018/0338642 A1 * 11/2018 Staiano ..... A47J 42/34
2019/0125132 A1 * 5/2019 Powers ..... A47J 42/38
2019/0263013 A1 * 8/2019 Bagley ..... B26D 3/11

* cited by examiner

*Primary Examiner* — Javier A Pagan
(74) *Attorney, Agent, or Firm* — Sanchelima & Associates, P.A.; Christian Sanchelima; Jesus Sanchelima

(57) ABSTRACT

A grinding tray for plant based smoking material including a top tray assembly and a bottom tray assembly. The top tray assembly includes a top tray, a top recessed collection area that allows a ground material to be collected when sliding, top bump grinds that grind the plant material when the user rubs it against said top bump grinders, and a ring support that allows a rounded grinder to be held in place. The bottom tray assembly includes a bottom tray symmetrical with respect to the top tray, allowing the top tray to be placed on top of said bottom tray. The bottom tray assembly further includes a bottom recessed collection area and bottom bump grinders as the top tray includes, and a screen grinder, thereby the top tray or the bottom tray may be used as the user may consider appropriate for grinding a plant-based material.

11 Claims, 4 Drawing Sheets

GRINDING TRAY FOR PLANT BASED SMOKING MATERIAL

1. FIELD OF THE INVENTION

The present invention relates to a grinding tray and, more particularly, to a grinding tray for plants based smoking material that includes a tray assembly with grinding bumps and a grinding screen for grinding a plant material to be collected in a recessed area of the trays.

2. DESCRIPTION OF THE RELATED ART

Several designs for grinding tray for plant based smoking materials have been designed in the past. None of them, however, include a tray with grinding bumps placed in a portion of a top surface wherein a screen grinder is placed between the grinding bumps, said elements are used to pick apart a predetermined plant to then be collected in a recessed pinch area placed on the tray.

Applicant believes that a related reference corresponds to U.S. Pat. No. 9,402,420 issued for smoking accessory kit system. Applicant believes that another related reference corresponds to U.S. Pat. No. 11,014,733 issued for herb tray with cone fillers. None of these references, however, teach of a grinding tray for plant-based smoking material that is comprised of a slanted tray assembly with a grinding screen and grinding plates disposed near the top of the tray as well as a central slot for receiving a rotating grinder where the tray is used to direct and collect the ground plant material into recessed collection area.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a multipurpose workstation for smokers.

It is another object of this invention to provide a stylish alternative to traditional collection/grinding trays.

It is still another object of the present invention to provide a simplification of the grinding and collection cannabis process.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
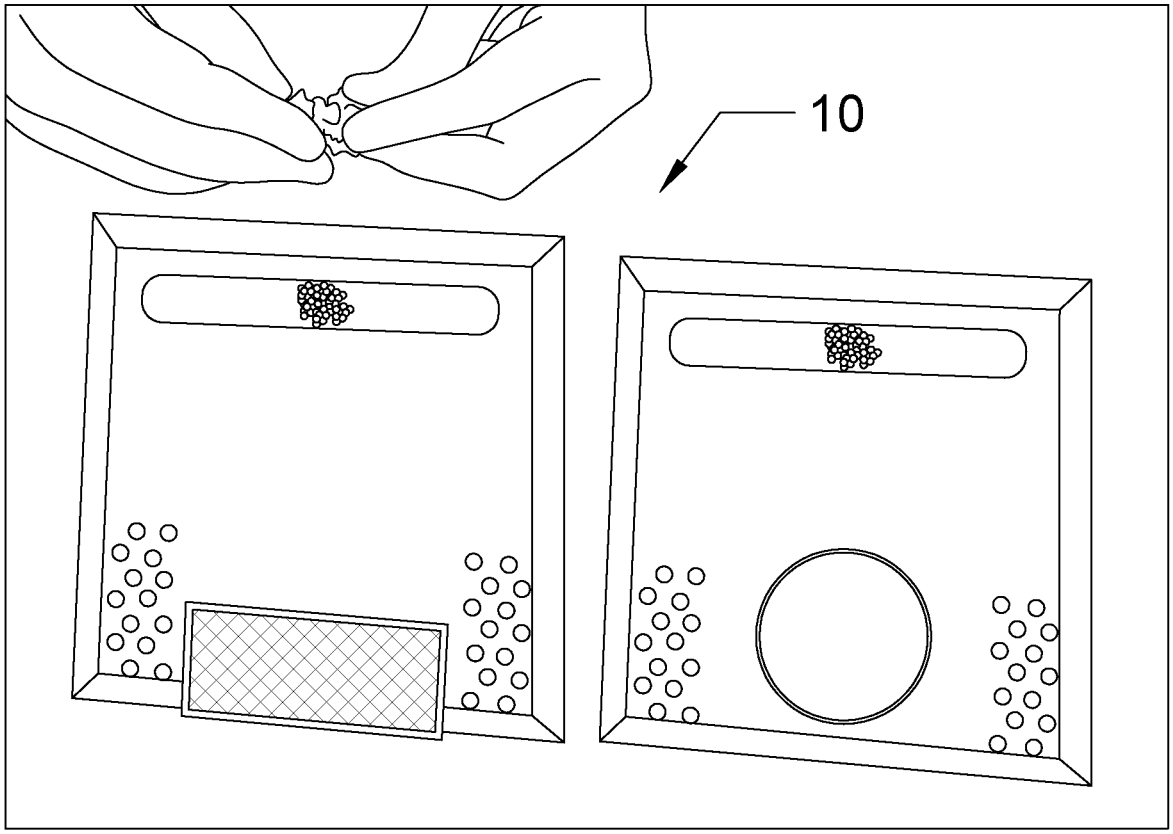

With the above and other related objects in view, the invention consists in the details of construction and combination of parts as will be more fully understood from the following description, when read in conjunction with the accompanying drawings in which:

FIG. 1 represents an operational view of an exemplary embodiment of the present invention 10.

Figure 2:
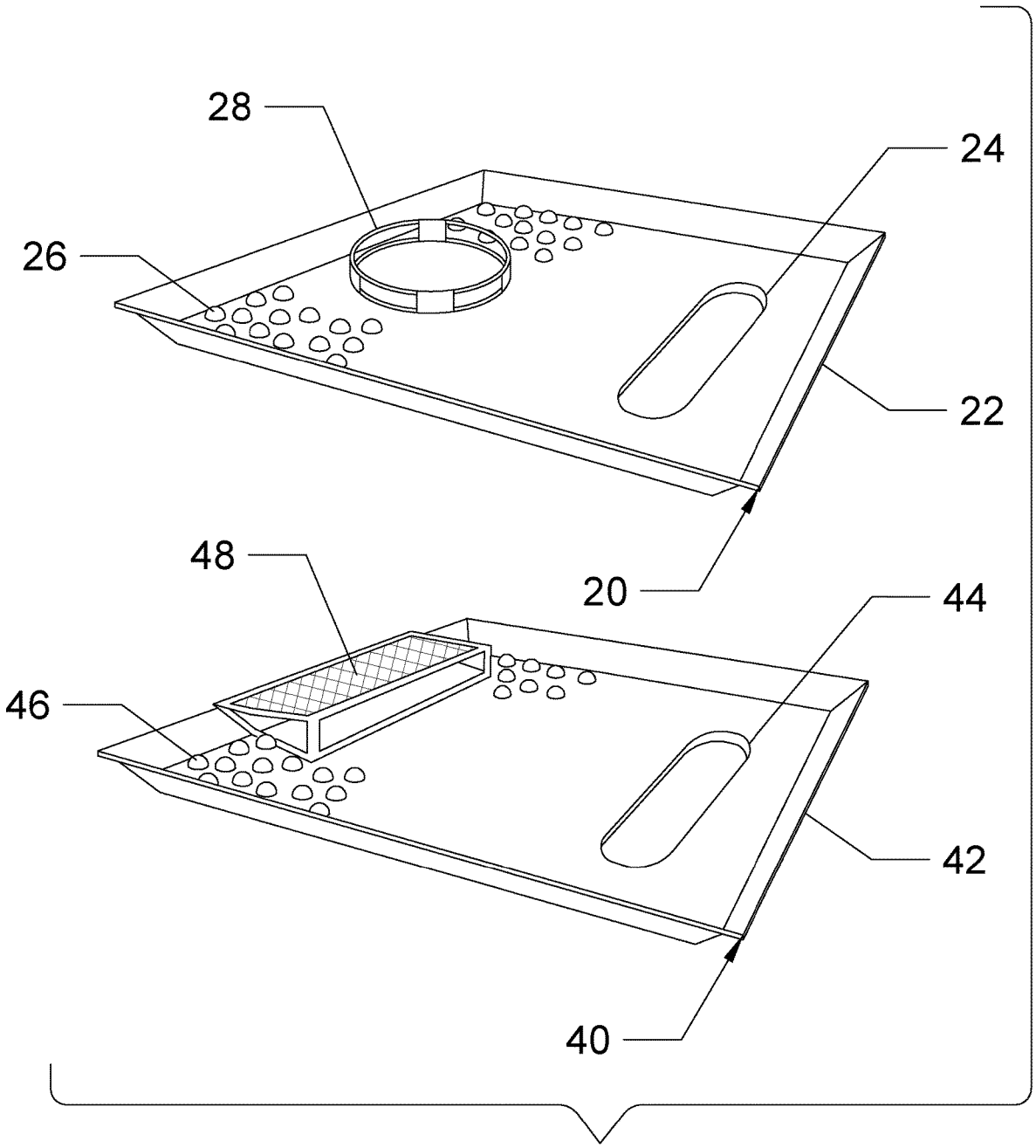

FIG. 2 shows an isometric exploded view of the top tray assembly 20 and the bottom tray assembly 40, wherein said top tray assembly may be placed on top of said bottom tray assembly 40.

Figure 3:
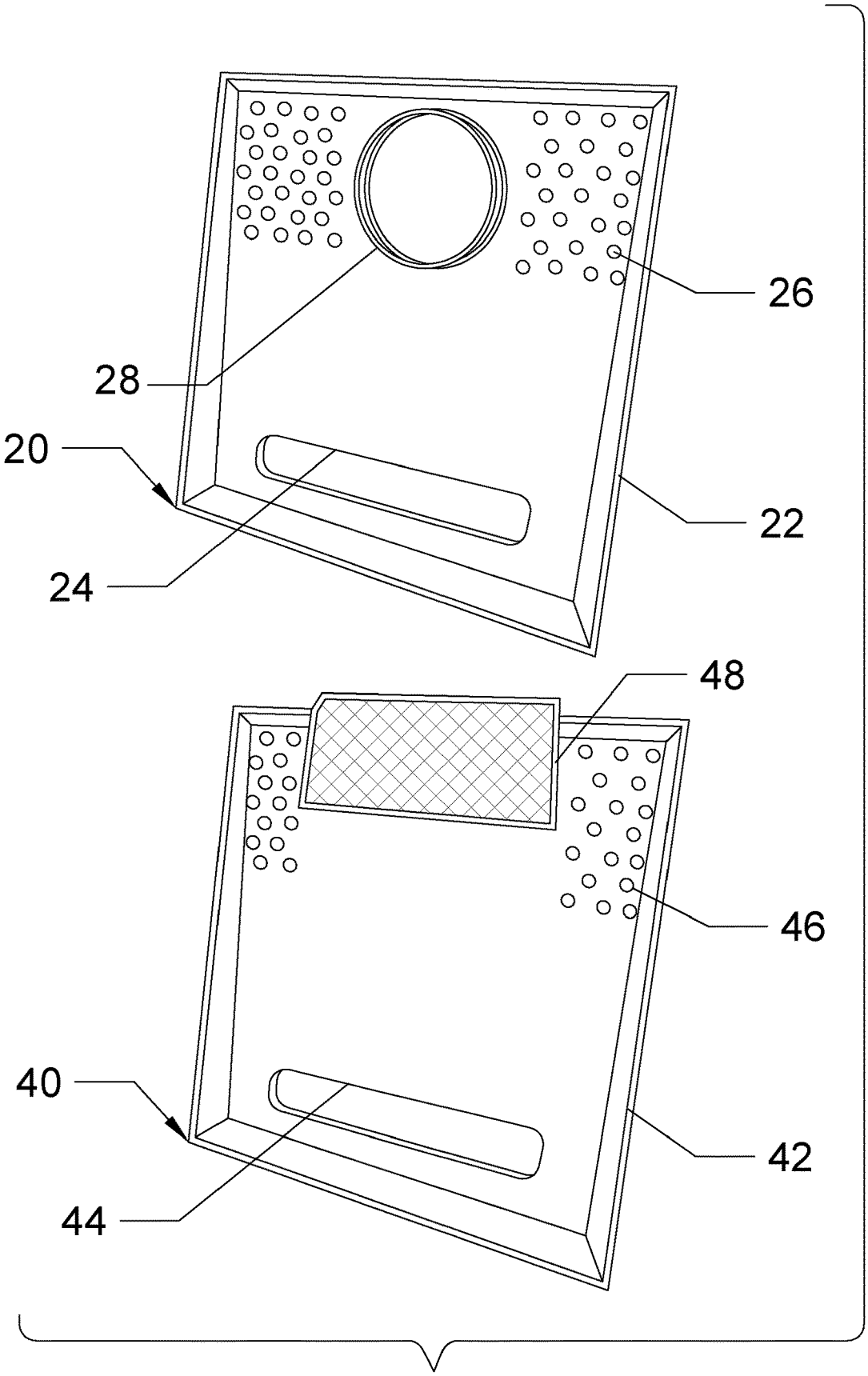

FIG. 3 illustrates a front view of the present invention 10, wherein the top tray assembly includes a ring support 28 for a well-known rotating grinder and bottom assembly includes a screen grinder 48 that grinds the plant.

Figure 4:
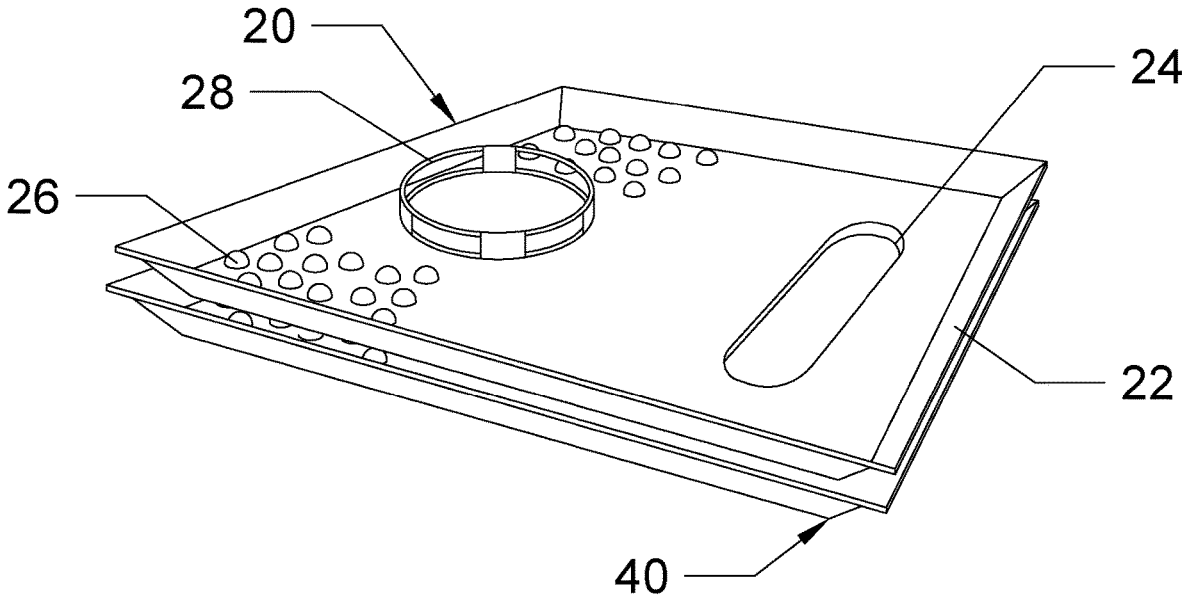

FIG. 4 is a representation of an isometric view of the assembly between the top tray assembly 20 and the bottom tray assembly 40.

V. DETAILED DESCRIPTION OF THE EMBODIMENTS OF THE INVENTION

Referring now to the drawings, where the present invention is generally referred to with numeral 10, it can be observed that it basically includes a tray assembly 20, a grinding assembly 40, and a support assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Top tray assembly 20, includes a top tray 22, a top recessed collection area 24, top bump grinders 26, and a ring support 28. In an exemplary embodiment, the top tray 22 may be a flat receptacle with raised edges. As shown in FIG. 2. The top tray 22 may have a slanted top surface which said slanted top surface is configured to slide ground plant material from a top portion towards a bottom portion thereof. The raised edges of top tray 22 may have a slanted configuration with respect to a parallel axis of the flat surface thereof. As best illustrated in FIG. 2. Nonetheless, it should be considered that the raised edges of the top tray 22 may be parallel with respect to the flat bottom surface thereof. In a suitable embodiment, the top tray 22 may be made of wood, metal, plastic, or any other suitable material to collect the ground plant material. In a preferred embodiment, the top tray 22 includes in a top surface thereof a top recessed collection area 24, wherein the recessed collection area may be placed near to the bottom edge of the tray. As best depicted in FIG. 4. In a preferred embodiment, the recessed collection area 24 may have a depth smaller with respect to the thickness of the slanted bottom edge of the top tray 22. It should be considered that the recessed collection area may have a slanted bottom area configured to receive the ground plant material. As shown in FIG. 1. in a suitable embodiment, top bump grinders 26 may have a half-spherical shape, nevertheless it should be considered that the top bump grinders 26 may have a cylindrical shape, a cuboid shape, a pyramid shape, a cone shape, or any other suitable shape to grind the plant material by rubbing it against the top bump grinders 26. In a preferred embodiment, top bump grinders 26 may be placed in a top portion of the top surface of the top tray 22, wherein the ring support 28 may be placed in a portion onto the top tray 22 and between the top bump grinders 26. As best depicted in FIG. 3. The top bump grinders 26 may be made of wood, metal, plastic, or any other suitable material for grinding the plant material. It should be considered that the top bump grinders 26 may be removably attachable to the top tray 22, thereby each bump grinder of the top bump grinders 26 may be replaced. In one embodiment, the ring support 28 may attached onto the surface of the top tray 22 As shown in FIG. 2. The ring support 28 may have a ring-shape that conforms with the shape of a rotating grinder well known in prior art, thereby the user may couple the rotating grinder into the ring support when coupled to the top tray 22 to grind the plant material.

It should be considered that the ring support 28 may be removably attachable to the top tray 22, thereby the ring support may be replaced for another suitable ring support for the various rotating grinders known in the art.

Bottom tray assembly 40 includes a bottom tray 42, a bottom recessed collection area 44, bottom bump grinders 46, and a screen grinder 48. In an exemplary embodiment, the bottom tray 42 may be a flat receptacle with raised edges. As shown in FIG. 2. The bottom tray 42 may have a slanted top surface which said slanted top surface is configured to slide ground plant material from a top portion towards a bottom portion thereof. The raised edges of bottom tray 42 may have a slanted configuration with respect to a parallel axis of the flat surface thereof. As best illustrated in FIG. 2. Nonetheless, it should be considered that the raised edges of the bottom tray 22 may be parallel with respect to the flat bottom surface thereof. In a suitable embodiment, the bottom tray 22 may be made of wood, metal, plastic, or any other suitable material to collect the ground plant material. In a preferred embodiment, the bottom tray 42 includes in a top surface thereof a bottom recessed collection area 44, wherein the recessed collection area may be placed near to the bottom edge of the bottom tray. As best depicted in FIG. 3. In a preferred embodiment, the bottom recessed collection area 44 may have a depth smaller with respect to the thickness of the slanted bottom edge of the bottom tray 42. It should be considered that the bottom recessed collection area 44 may have a slanted bottom area configured to receive the ground plant material. As shown in FIG. 1. in a suitable embodiment, bottom bump grinders 46 may have a half-spherical shape, nevertheless it should be considered that the bottom bump grinders 46 may have a cylindrical shape, a cuboid shape, a pyramid shape, a cone shape, or any other suitable shape to grind the plant material by rubbing it against the bottom bump grinders 46. In a preferred embodiment, bottom bump grinders 46 may be placed in a top portion of the bottom surface of the bottom tray 22, wherein the screen grinder 48 may be placed in a portion onto the bottom tray 42 and between the bottom bump grinders 46. As best depicted in FIG. 3. The bottom bump grinders 46 may be made of wood, metal, plastic, or any other suitable material for grinding the plant material. It should be considered that the bottom bump grinders 46 may be removably attachable to the bottom tray 42, thereby each bump grinder of the bottom bump grinders 46 may be replaced. In one embodiment, the screen 48 may attached onto the surface of the top tray 22 As shown in FIG. 2. In one embodiment, screen grinder 48 may be a mesh held in a frame, wherein said screen grinder may have a predetermined separation with respect to the bottom surface of the bottom tray 42. As shown in FIG. 2. The screen grinder 48 may have a frame that conforms with the shape of the slanted top surface of the bottom tray 42 and the raised edge thereof, thereby the screen grinder 48 may be placed at the top portion of the bottom tray 42, wherein the plant material placed on top of the screen grinder 48 may be rubbed for grinding, therefore the ground plant material may slide towards the bottom recessed collection area 44 As best depicted in FIG. 1. In a suitable variation of the screen grinder 48, the mesh that grinds the material plan may be a perforated frame, a frame with a plurality of holes, or any other suitable variation to grind and filter the plant material. In a suitable embodiment, the screen grinder 48 including the mash for grinding may be made of metal, wood, aluminum, plastic, or any other suitable material that supports being pressed by means of the user's hand without breaking when grinding the plant material. It should be considered that the screen grinder 48 may be removably attachable to the bottom tray 42 as the user may consider appropriate.

Referring to the figures of an exemplary embodiment of the present invention 10 and more particularly to FIG. 1, the user may select either the top tray 22, or the bottom tray 42 to grind the plant material, thereby the ground plant material may be collected from the recessed collection area of each tray.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A grinding tray for plant based smoking material, comprising:

a tray assembly including a top tray, a top recessed collection area, top bump grinders and a ring support, wherein the top tray is a flat receptacle that holds said top bump grinders and said ring support, said ring support is a ring with supports attached to a surface of said top tray, said top recessed collection area at a bottom portion of said top tray; and a bottom tray assembly having a bottom tray, a bottom recessed collection area, bottom bump grinders and a screen grinder, wherein said bottom tray is a receptacle symmetrical with respect to said top tray, said top tray is removably attachable to said bottom tray, wherein said bottom recessed collection area is placed at a bottom section of said bottom tray, said bottom bump grinders are bump-shaped grinders attached onto said bottom tray.

2. The grinding tray for plant based smoking material of claim 1, wherein said top tray and said bottom tray are rectangular-shaped receptacles.

3. The grinding tray for plant based smoking material of claim 1, wherein said top tray and said bottom tray includes a raised edges along a circumference thereof.

4. The grinding tray for plant based smoking material of claim 1, wherein said top tray and said bottom tray have a slanted top surface that allow ground material to slide downwards of said slanted top surface respectively.

5. The grinding tray for plant based smoking material of claim 1, wherein said top bump grinders and said bottom bump grinders are half-spherical shaped bumps that allows a plant material to be ground while rubbing against thereof.

6. The grinding tray for plant based smoking material of claim 1, wherein said top recessed collection area and said bottom recessed collection area are rectangular-shaped slanted indentations that allows to collect said ground material while sliding.

7. The grinding tray for plant based smoking material of claim 1, wherein said wherein said ring support is a ring-shaped support attached between said top bump grinders and said top recessed collection area that allows a rounded grinder to be held in placed onto said top tray.

8. The grinding tray for plant based smoking material of claim 1, wherein said screen grinder is a mesh held in a frame onto said bottom surface between said bottom bump grinders.

9. The grinding tray for plant based smoking material of claim 1, wherein said screen grinder allows said plant material to be ground while rubbing against thereof.

10. A grinding tray for plant based smoking material, comprising:

a tray assembly including a top tray, a top recessed collection area, top bump grinders and a ring support, wherein the top tray is a flat rectangle-shaped receptacle with raised edges that holds said top bump grinders and said ring support, said top tray has a slanted top surface that allows a ground plant material to slide downward, said ring support is a ring with supports attached to the slanted top surface of said top tray, said top recessed collection area at a bottom portion of said top tray, said top bump grinders have half-spherical shaped bumps; and a bottom tray assembly having a bottom tray, a bottom recessed collection area, bottom bump grinders and a screen grinder, wherein said bottom tray is a rectangular-shaped receptacle symmetrical with respect to said top tray, said top tray is removably attachable to said bottom tray, wherein said bottom recessed collection area is placed at a bottom section of said bottom tray, said bottom bump grinders are bump-shaped grinders attached onto said bottom tray, said bottom bump grinders have half-spherical shaped bumps.

11. A grinding tray for plant based smoking material, consisting of:

a tray assembly including a top tray, a top recessed collection area, top bump grinders and a ring support, wherein the top tray is a flat rectangle-shaped receptacle with raised edges along a circumference thereof that holds said top bump grinders and said ring support, said top tray has a slanted top surface that allows a ground plant material to slide downward, said ring support is a ring with supports attached to the slanted top surface of said top tray, said top recessed collection area at a bottom portion of said top tray, said top bump grinders have half-spherical shaped bumps that allow said plant material to be ground by rubbing against thereof, said recessed collection area is a rectangular-shaped indentation that allows said ground plant material to be collected, said ring support is a ring-shaped support attached between said top bump grinders that allows a rounded grinder to be held in place; and a bottom tray assembly having a bottom tray, a bottom recessed collection area, bottom bump grinders and a screen grinder, wherein said bottom tray is a rectangular-shaped receptacle symmetrical with respect to said top tray, said top tray is removably attachable to said bottom tray, wherein said bottom recessed collection area is placed at a bottom section of said bottom tray, said bottom recessed collection area is a rectangular-shaped slanted indentation that allows said ground material to be collected when sliding, said bottom bump grinders are bump-shaped grinders attached onto said bottom tray, said bottom bump grinders have half-spherical shaped bumps, said screen grinder is a mesh held by a frame between said bottom bump grinders that allows said plant material to be ground.

* * * * *